US009982918B2

(12) United States Patent
Lee et al.

(10) Patent No.: US 9,982,918 B2
(45) Date of Patent: May 29, 2018

(54) ENERGY SYSTEM

(71) Applicant: KOREA INSTITUTE OF ENERGY RESEARCH, Daejeon (KR)

(72) Inventors: Gil Bong Lee, Daejeon (KR); Jun Hyun Cho, Daejeon (KR); Young Soo Lee, Daejeon (KR); Hyung Ki Shin, Daejeon (KR); Young Jin Baik, Daejeon (KR); Ho Sang Ra, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 115 days.

(21) Appl. No.: 15/190,130

(22) Filed: Jun. 22, 2016

(65) Prior Publication Data

US 2017/0016651 A1 Jan. 19, 2017

(30) Foreign Application Priority Data

Jul. 15, 2015 (KR) ..... 10-2015-0100333

(51) Int. Cl.
*F25B 31/00* (2006.01)
*F25B 1/047* (2006.01)
(Continued)

(52) U.S. Cl.
CPC ..... *F25B 1/047* (2013.01); *F25B 25/005* (2013.01); *F25B 31/006* (2013.01); *F25B 41/00* (2013.01);
(Continued)

(58) Field of Classification Search
CPC ..... F25B 1/047; F25B 25/005; F25B 31/006; F25B 41/00; F25B 49/022; F25B 2500/26; F25B 2400/01; F25B 2339/047
See application file for complete search history.

(56) References Cited

U.S. PATENT DOCUMENTS 3,221,984 A * 12/1965 Ditzler ..... F25B 31/002 184/6
3,508,416 A * 4/1970 Miller ..... F04D 27/0246 62/193
(Continued)

FOREIGN PATENT DOCUMENTS

JP S6176710 A * 4/1986
JP S6433471 A * 2/1989
(Continued)

OTHER PUBLICATIONS

Watanabe et al., High Pressure . . . Control Method . . . , Nov. 14, 2003, JP2003322421A, Whole Document.*
(Continued)

*Primary Examiner* — Larry Furdge
(74) *Attorney, Agent, or Firm* — Revolution IP, PLLC

(57) ABSTRACT

A heating medium supplied to an evaporator is used to heat lubricant oil in a screw compressor before the screw compressor starts up, and no additional heater for heating the lubricant oil in the screw compressor is required. When the screw compressor operates, the heating medium discharged from the evaporator after the evaporator is heated by the heating medium, is used to cool the lubricant oil. The lubricant oil heated by a lubricant oil heat exchanger is directly injected into a motor and a screw rotor so that introduction of a liquid refrigerant into a compressive chamber is reduced when the screw compressor starts up later. The lubricant oil introduced into the motor is discharged toward a lubricant oil storage portion before the screw compressor starts up so that the liquid refrigerant is prevented in advance from being introduced into the screw rotor when the screw compressor starts up.

10 Claims, 7 Drawing Sheets

(51) Int. Cl.
*F25B 41/00* (2006.01)
*F25B 49/02* (2006.01)
*F25B 25/00* (2006.01)

(52) U.S. Cl.
CPC ..... *F25B 49/022* (2013.01); *F25B 2339/047* (2013.01); *F25B 2400/01* (2013.01); *F25B 2500/26* (2013.01)

(56) References Cited

U.S. PATENT DOCUMENTS

| | | | | |
|---|---|---|---|---|
| 5,222,874 | A * | 6/1993 | Unnewehr | F04C 29/042 417/372 |
| 6,886,354 | B2 * | 5/2005 | Dudley | F04B 39/0207 417/13 |
| 2009/0191082 | A1 * | 7/2009 | Yoshimura | F01C 21/04 418/83 |

FOREIGN PATENT DOCUMENTS

| | | | | |
|---|---|---|---|---|
| JP | 2747480 | B2 | | 5/1998 |
| JP | 2003322421 | A | * | 11/2003 |
| JP | 3934601 | B2 | | 3/2005 |
| JP | 3877207 | B2 | | 2/2007 |
| KR | 10-0611271 | B1 | | 8/2006 |
| KR | 10-0680617 | B1 | | 2/2007 |
| KR | 10-0990570 | B1 | | 10/2010 |

OTHER PUBLICATIONS

Sumitomo et al., Waste Heat Recovery Equipment, Apr. 19, 1986, JPS6176710A, Whole Document.*

Ebara, Cooling Device for Compressor, Feb. 3, 1989, JPS6433471A, Whole Document.*

* cited by examiner

ENERGY SYSTEM

CROSS-REFERENCE TO RELATED PATENT APPLICATION

This application claims the benefit of Korean Patent Application No. 10-2015-0100333, filed on Jul. 15, 2015, in the Korean Intellectual Property Office, the disclosure of which is incorporated herein in its entirety by reference.

BACKGROUND OF THE INVENTION

1. Field of the Invention

The present invention relates to an energy system, and more particularly, to an energy system capable of protecting a compressor by heating lubricant oil and a refrigerant in a screw compressor.

2. Description of the Related Art

In general, a screw compressor compresses a low-pressure refrigerant gas with a high pressure. The screw compressor cools heat of the refrigerant gas generated between two screw rotors, and lubricant oil is continuously supplied into the screw compressor so that leakage of the refrigerant gas compressed in the two screw rotors can be prevented and a bearing, etc. can be cooled and lubricated. A lubricant oil storage chamber is provided in the screw compressor, and the lubricant oil collected in the lubricant oil storage chamber is supplied to the screw rotors, the bearing, a motor, etc. via each lubricant oil supply line, and the lubricant oil mixed with a refrigerant in the screw rotors is separated and recovered from a lubricant oil separator and then is collected into the lubricant oil storage chamber again.

When a system including the screw compressor stops, a liquid refrigerant is introduced into the screw compressor, and the liquid refrigerant and the lubricant oil are mixed with each other such that the lubricant oil is cooled and the concentration of the mixture is lowered and damage occurs when the screw compressor starts up. Thus, a crank heater, etc. is installed in the screw compressor for warming-up of the screw compressor. However, the crank heater consumes a large amount of power when operating such that the efficiency of the system is lowered. Also, the screw compressor should be managed at a predetermined temperature or less so as to acquire a lubricating capability while the system operates, and an additional device therefor is required.

SUMMARY OF THE INVENTION

The present invention provides an energy system capable of heating a refrigerant and lubricant oil in a screw compressor before start-up and cooling the lubricant oil while operating.

According to an aspect of the present invention, there is provided an energy system including: a screw compressor; a condenser; an expansion device; an evaporator; an evaporator heat source flow path configured to provide a heating medium supplied from an outside as a heat source of the evaporator; a lubricant oil heat-exchanging unit configured to perform a heat-exchanging operation of the heating medium on an evaporator heat source flow path and lubricant oil including a refrigerant inside the screw compressor, to heat the lubricant oil by the heating medium before the screw compressor starts up, and to cool the lubricant oil by the heating medium discharged from the evaporator after the evaporator is heated by the heating medium, after the screw compressor starts up; and a controller configured to control the lubricant oil heat-exchanging unit depending on whether the screw compressor starts up.

According to another aspect of the present invention, there is provided an energy system including: a screw compressor; a condenser; an expansion device; an evaporator; a lubricant oil heat-exchanger configured to perform a heat-exchanging operation of lubricant oil in a lubricant oil storage portion provided in the screw compressor and a heating medium on an evaporator heat source flow path; a lubricant oil circulation flow path configured to connect the lubricant oil storage portion and the lubricant oil heat exchanger, to deliver the lubricant oil in the lubricant oil storage portion to the lubricant oil heat exchanger, and to circulate the lubricant oil heat-exchanged by the lubricant oil heat exchanger into the lubricant oil storage portion; a lubricant oil circulation pump installed on the lubricant oil circulation flow path and configured to pump the lubricant oil in the lubricant oil storage portion; an injection flow path configured to inject the lubricant oil bypassed via the lubricant oil circulation flow path and heat-exchanged by the lubricant oil heat exchanger into the screw compressor; an injection flow path opening/closing valve installed on the injection flow path; a lubricant oil discharge flow path configured to guide the lubricant oil including the refrigerant at a motor provided in the screw compressor to be discharged toward the lubricant oil storage portion; a lubricant oil discharge pump installed on the lubricant oil discharge flow path; and a controller, before the screw compressor starts up, configured to operate the lubricant oil circulation pump and the lubricant oil discharge pump and to open the injection flow path opening/closing valve, and when temperature inside the screw compressor reaches a preset temperature, configured to stop an operation of the lubricant oil circulation pump and an operation of the lubricant oil discharge pump and to close the injection flow path opening/closing valve.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
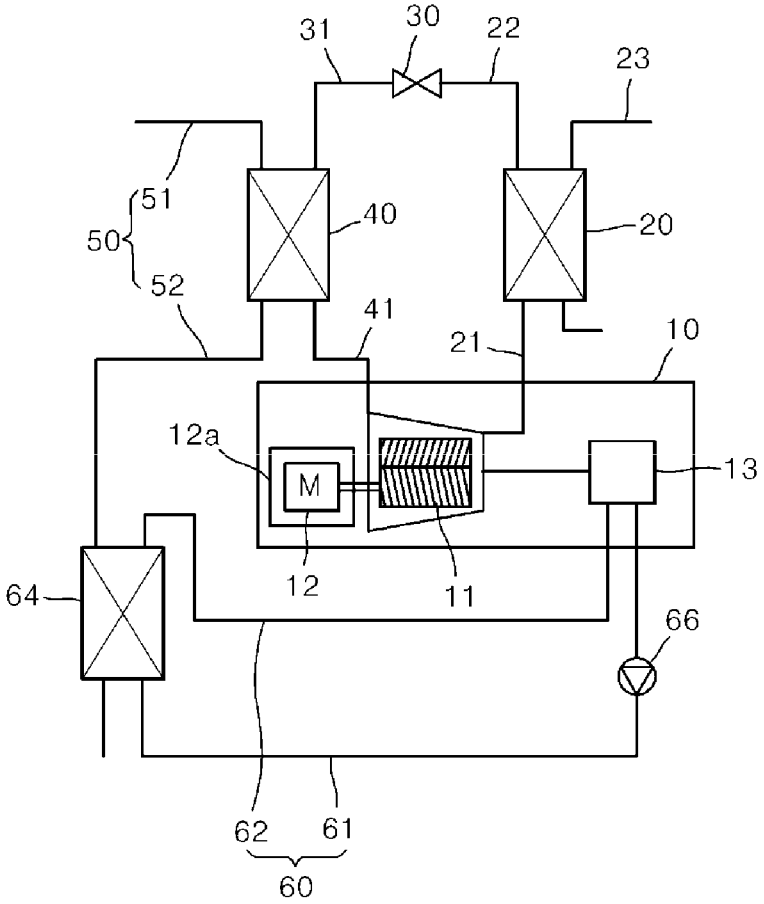
FIG. 1 is a schematic view of a configuration of an energy system according to a first embodiment of the present invention.
Figure 2:
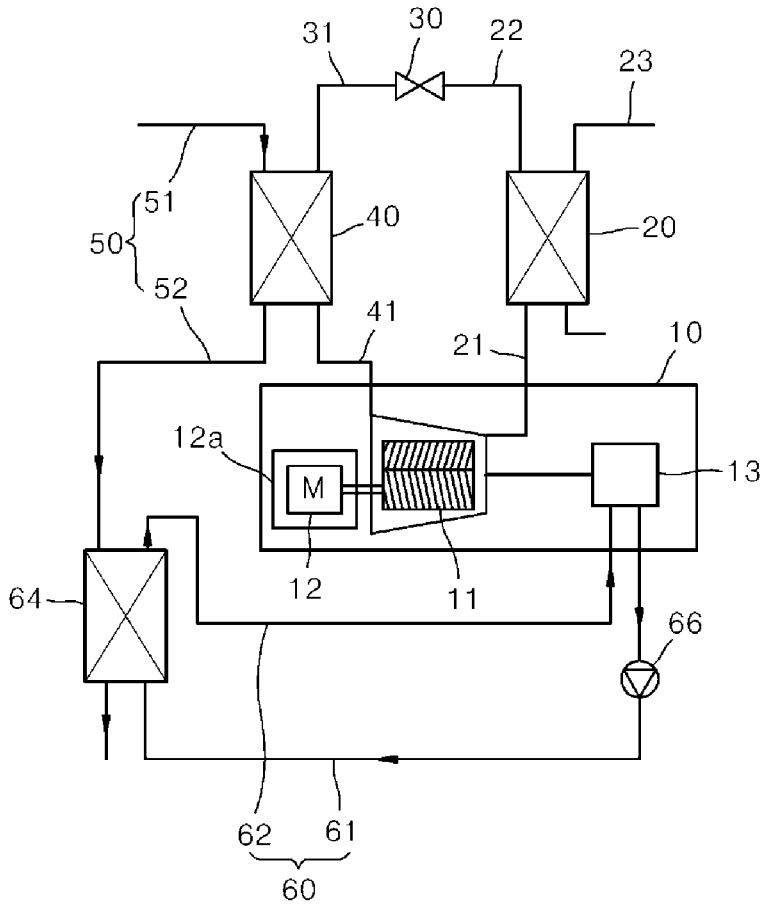
FIG. 2 is a view illustrating an operating state of the energy system illustrated in FIG. 1 in which lubricant oil is heated before a screw compressor starts up.

FIG. 1 is a schematic view of a configuration of an energy system according to a first embodiment of the present invention, and FIG. 2 is a view illustrating an operating state of the energy system illustrated in FIG. 1 in which lubricant oil is heated before a screw compressor starts up.

Referring to FIGS. 1 and 2, the energy system will be described as a heat pump, for example. The heat pump includes a screw compressor 10, a condenser 20, an expansion device 30, an evaporator 40, an evaporator heat source flow path 50, a lubricant oil heat-exchanging unit, and a controller.

The screw compressor 10 includes a screw rotor 11, a motor 12, and a lubricant oil storage portion 13, which are disposed inside a housing. The screw rotor 11 will be described as two twin screw rotors, for example. The two twin screw rotors 11 are connected to the motor 12. The lubricant oil storage portion 13 may be formed below the screw rotors 11 or may be formed integrally with a lubricant oil separator (not shown) that separates lubricant oil including a refrigerant discharged from a compressive chamber including the screw rotors 11. The inside of the housing may be partitioned off into a motor chamber 12*a* in which the motor 12 is disposed, and the compressive chamber in which the screw rotors 11 are disposed.

The condenser 20 condenses the refrigerant discharged from the screw compressor 10 using an external cooling source 23, etc. The external cooling source 23 is used as a heating medium for generating steam, etc. The condenser 20 and the screw compressor 10 are connected to each other via a compressor discharge flow path 21.

The expansion device 30 is an expansion valve that expands the refrigerant condensed by the condenser 20. The expansion device 30 and the condenser 20 are connected to each other via a condenser discharge flow path 22.

The evaporator 40 evaporates the refrigerant expanded by the expansion device 30 using the heating medium supplied from the outside. The evaporator 40 and the expansion device 30 are connected to each other via an expansion device discharge flow path 31.

The evaporator heat source flow path 50 is connected to the evaporator 40 and supplies the heating medium supplied from the outside to the evaporator 40, thereby providing a heat source. Here, the heating medium may use waste heat in an industrial process, etc. The evaporator heat source flow path 50 includes an evaporator heat source supply flow path 51 in which the heat source is supplied to the evaporator 40, and an evaporator heat source discharge flow path 52 in which the heat source is discharged from the evaporator 40 after the evaporator 40 is heated by the heat source.

The lubricant oil heat-exchanging unit performs a heat-exchanging operation of the heating medium discharged from the evaporator heat source discharge flow path 52 after the evaporator 40 is heated by the heating medium, and lubricant oil including the refrigerant inside the screw compressor 10 (hereinafter, referred to as 'lubricant oil'). The temperature of the lubricant oil may be maintained at an appropriate level so that the viscosity of the lubricant oil may be secured.

The lubricant oil heat-exchanging unit includes a lubricant oil heat exchanger 64, a lubricant oil circulation flow path 60, and a lubricant oil circulation pump 66.

The lubricant oil heat exchanger 64 is a heat exchanger that performs a heat-exchanging operation of the heating medium on the evaporator heat source flow path 50 and lubricant oil including the refrigerant inside the screw compressor 10. That is, the lubricant oil heat exchanger 64 is installed between the evaporator heat source discharge flow path 52 and the lubricant oil circulation flow path 60. Before the screw compressor 10 starts up, the heating medium on the evaporator heat source discharge flow path 52 is supplied to the lubricant oil heat exchanger 64 in a state in which heat-exchanging of the heating medium and the lubricant oil is not performed in the evaporator 40, and after the screw compressor 10 starts up, the heating medium on the evaporator heat source discharge flow path 52 is supplied to the lubricant oil heat exchanger 64 in a state in which the heat medium is discharged from the evaporator heat source discharge flow path 52 after the evaporator 40 is heated by the heating medium. Thus, the lubricant oil heat exchanger 64 may be used to heat the lubricant oil before the screw compressor 10 starts up, and after the screw compressor 10 starts up and when the screw compressor 10 operates normally, the lubricant oil heat exchanger 64 may be used to cool the lubricant oil. However, embodiments of the present invention are not limited thereto, and a bypass flow path (not shown) formed to bypass the evaporator 40 on the evaporator heat source flow path 50 is provided. Thus, the bypass flow path (not shown) may be connected to the lubricant oil heat exchanger 64 so that heat of the heating medium may also be supplied to the lubricant oil heat exchanger 64 via the bypass flow path (not shown).

The lubricant oil circulation flow path 60 includes a first lubricant oil circulation flow path 61 that is connected to the lubricant oil heat exchanger 64 from the lubricant oil storage portion 13 and formed to discharge lubricant oil in the lubricant oil storage portion 13 toward the lubricant oil heat exchanger 64, and a second lubricant oil circulation flow path 62 that is connected to the lubricant oil storage portion 13 from the lubricant oil heat exchanger 64 and formed to circulate the lubricant oil heated by the lubricant oil heat exchanger 64 into the lubricant oil storage portion 13.

The lubricant oil circulation pump 66 is installed on the first oil lubricant circulation flow path 61 and pumps the lubricant oil in the lubricant oil storage portion 13. An operation of the lubricant oil circulation pump 66 is controlled by the controller (not shown).

The controller (not shown) operates the lubricant oil circulation pump 66 before the screw compressor 10 starts up. Also, the controller (not shown) controls an operation of the lubricant oil circulation pump 66 according to the temperature inside the screw compressor 10 since the lubricant oil circulation pump 66 starts to operate. The temperature inside the screw compressor 10 is the temperature of the lubricant oil.

An operation of the energy system (the heat pump) having the above configuration according to the first embodiment of the present invention will be described as below.

Referring to FIG. 2, the controller operates the lubricant oil circulation pump 66 before the screw compressor 10 starts up.

When the lubricant oil circulation pump 66 operates, the lubricant oil in the lubricant oil storage portion 13 is introduced into the lubricant oil heat exchanger 64 via the first lubricant oil circulation flow path 61. The lubricant oil in the lubricant oil storage portion 13 is lubricant oil including the refrigerant, and hereinafter, is referred to as lubricant oil.

The lubricant oil heat exchanger 64 performs a heat-exchanging operation of the lubricant oil introduced via the first lubricant oil circulation flow path 61 and the heating medium on the evaporator heat source discharge flow path 52. Before the screw compressor 10 starts up, a heating-exchanging operation of the heating medium on the evaporator heat source flow path 50 and the refrigerant is not performed by the evaporator 40 so that heat of the heating medium on the evaporator heat source flow path 50 may be intactly supplied to the lubricant oil heat exchanger 64. That is, before the screw compressor 10 starts up, the temperature of the heating medium on the evaporator heat source discharge flow path 52 is higher than a room temperature so that the heating medium on the evaporator heat source discharge flow path 52 may be be provided as a sufficient heat source for heating the lubricant oil using the lubricant oil heat exchanger 64. Thus, when the lubricant oil is heated by the heating medium using the lubricant oil heat exchanger 64 and the temperature of the lubricant oil is increased, the refrigerant in the lubricant oil is vaporized, and the viscosity of the lubricant oil may be secured.

The lubricant oil heated by the lubricant oil heat exchanger 64 is circulated into the lubricant oil storage portion 13 via the second lubricant oil circulation flow path 62. When the lubricant oil heated by the lubricant oil heat exchanger 64 is supplied to the screw compressor 10, the temperature inside the screw compressor 10 is increased so that pressure of the entire system is increased and damage may be be prevented from occurring due to a low pressure when the screw compressor 10 starts up. Also, the lubricant oil heated by the lubricant oil heat exchanger 64 and supplied to the screw compressor 10 may absorb or vaporize a part of the refrigerant in the compressive chamber of the screw compressor 10 when the screw compressor 10 starts up so that damage caused by flooded start may be reduced.

The controller (not shown) operates the lubricant oil circulation pump 66 until the temperature inside the screw compressor 10 is equal to or higher than a preset temperature. Here, the preset temperature will be about 60° for example. When the temperature inside the screw compressor 10 reaches the preset temperature, the controller (not shown) stops an operation of the lubricant oil circulation pump 66.

Subsequently, the screw compressor 10 may start up so that the energy system may operate normally. When the screw compressor 10 starts up and operates normally, the refrigerant compressed by the screw compressor 10 is condensed by the condenser 20, and the refrigerant condensed by the condenser 20 is expanded by the expansion device 30 and then is introduced into the evaporator 40. After the refrigerant is heated by the heating medium introduced via the evaporator heat source flow path 50 and evaporated using the evaporator 40, the refrigerant circulates into the screw compressor 10.

While the screw compressor 10 operates normally, as described above, when the temperature of the lubricant oil in the screw compressor 10 is equal to or higher than the preset temperature, the lubricant oil circulation pump 66 may operate for cooling of the lubricant oil.

When the lubricant oil circulation pump 66 operates, the lubricant oil in the lubricant oil storage portion 13 is introduced into the lubricant oil heat exchanger 64 via the first lubricant oil circulation flow path 61.

The lubricant oil heat exchanger 64 performs a heat-exchanging operation of the heating medium discharged from the evaporator 40 after the evaporator 40 is heated by the heating medium, and the lubricant oil. Because heat of the heating medium is taken when the evaporator 40 is heated by the heating medium, the temperature of the heating medium is lower than the temperature of the lubricant oil. Thus, cooling of the lubricant oil may be performed by the lubricant oil heat exchanger 64.

Thus, no additional heater, etc. for heating the lubricant oil in the screw compressor 10 is required so that there is no power consumption for driving the heater, etc. and thus efficiency may be improved.

In addition, the heating medium that is not used as the heat source for the evaporator 40 is used to heat the lubricant oil before the screw compressor 10 starts up so that the efficiency of energy usage may be further improved.

In addition, when the screw compressor 10 operates, the heating medium discharged from the evaporator 40 after the evaporator 40 is heated by the heating medium, is used to cool the lubricant oil so that the efficiency of energy usage may be further improved.

Figure 3:
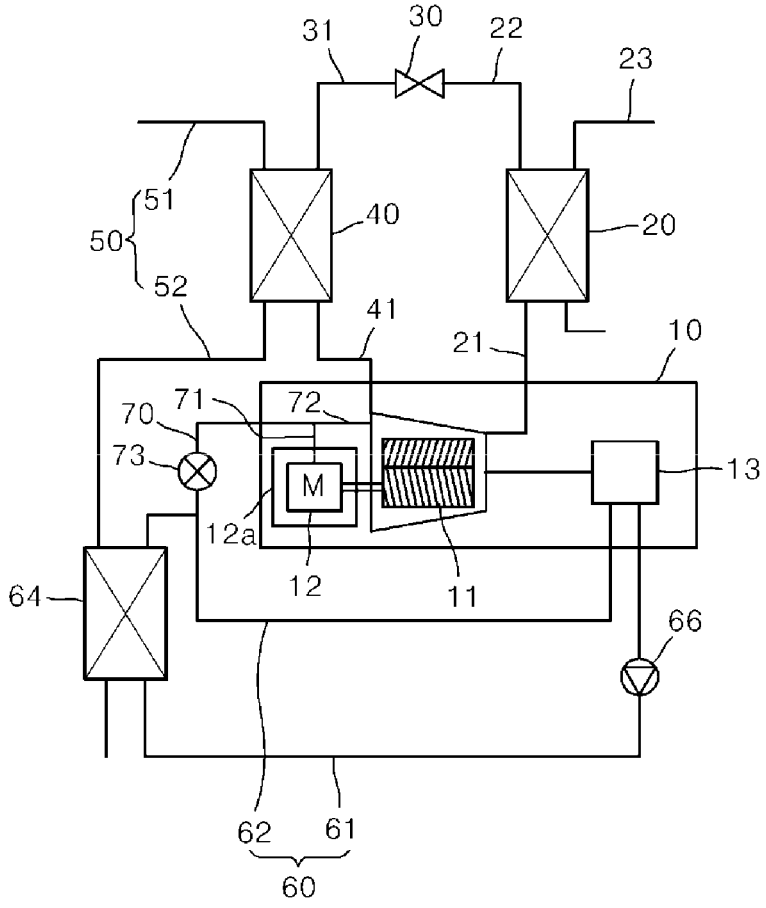
FIG. 3 is a schematic view of a configuration of an energy system according to a second embodiment of the present invention.
Figure 4:
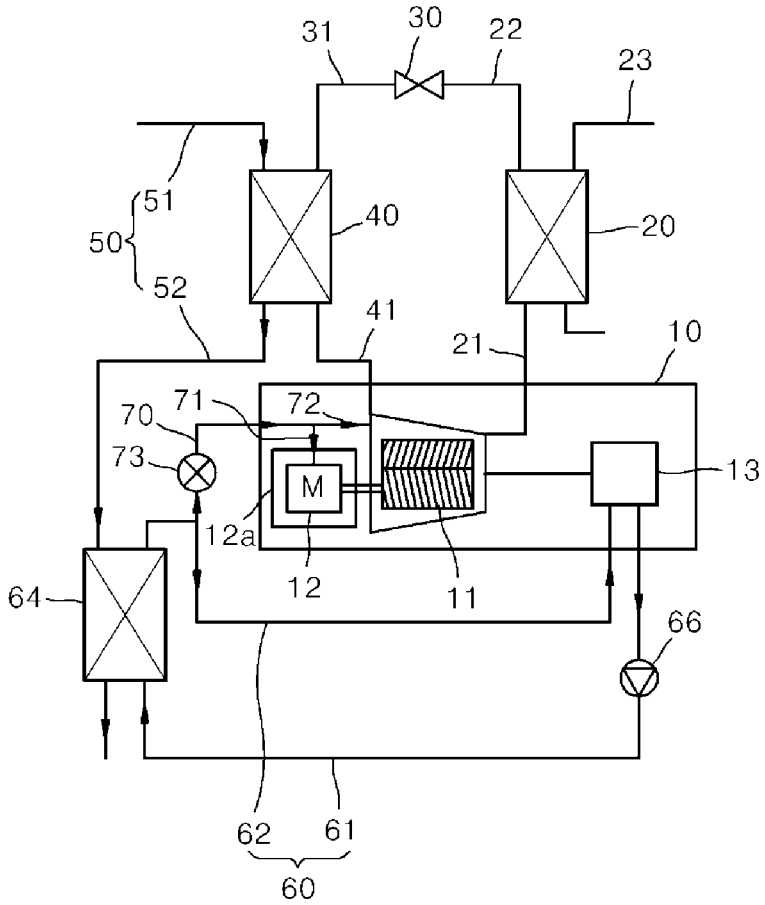
FIG. 4 is a view illustrating an operating state of the energy system illustrated in FIG. 3 in which lubricant oil is heated before a screw compressor starts up.

FIG. 3 is a schematic view of a configuration of an energy system according to a second embodiment of the present invention, and FIG. 4 is a view illustrating an operating state of the energy system illustrated in FIG. 3 in which lubricant oil is heated before a screw compressor starts up.

Referring to FIGS. 3 and 4, the energy system according to the second embodiment of the present invention is a heat pump. A difference between the heat pump of the second embodiment and the heat pump of the first embodiment is that the heat pump according to the second embodiment further includes an injection flow path 70 that injects lubricant oil bypassed via the lubricant oil circulation flow path 60 and heat-exchanged by the lubricant oil heat exchanger 64 into an inside of the screw compressor 10. Thus, the difference will be described in detail.

The injection flow path 70 is a flow path in which the lubricant oil bypassed via the second lubricant oil circulation flow path 62 and heat-exchanged by the lubricant oil heat exchanger 64 is directly injected into the inside of the screw compressor 10. The injection flow path 70 includes a motor injection flow path 71 in which the lubricant oil heat-exchanged by the lubricant oil heat exchanger 64 is injected into the motor 12, and a screw rotor injection flow path 72 in which the lubricant oil heat-exchanged by the lubricant oil heat exchanger 64 is injected into the screw rotors 11. A nozzle may be formed at each end of the motor injection flow path 71 and the screw rotor injection flow path 72, or an additional nozzle may be combined with each end of the motor injection flow path 71 and the screw rotor injection flow path 72.

An injection flow path opening/closing valve 73 that controls injection of the lubricant oil by controlling opening/closing of the injection flow path 70 is installed on the injection flow path 70.

An operation of the energy system (the heat pump) having the above configuration according to the second embodiment of the present invention will be described as follows.

Referring to FIG. 4, before the screw compressor 10 starts up, the controller operates the lubricant oil circulation pump 66 and opens the injection flow path opening/closing valve 73.

When the lubricant oil circulation pump 66 operates, the lubricant oil in the lubricant oil storage portion 13 is introduced into the lubricant oil heat exchanger 64 via the first lubricant oil circulation flow path 61.

The lubricant oil heat exchanger 64 performs a heat-exchanging operation of the lubricant oil introduced via the first lubricant oil circulation flow path 61 and the heating medium on the evaporator heat source discharge flow path 52. Before the screw compressor 10 starts up, the heat-exchanging operation of the heating medium of the evaporator heat source flow path 50 and the refrigerant is not performed by the evaporator 40 so that heat of the heating medium on the evaporator heat source flow path 50 may be intactly supplied to the lubricant oil heat exchanger 64. That is, before the screw compressor 10 starts up, the temperature of the heating medium on the evaporator heat source discharge flow path 52 is higher than the room temperature so that the heating medium on the evaporator heat source discharge flow path 52 may be provided as a sufficient heat source for heating the lubricant oil in the lubricant oil heat exchanger 64. Thus, when the lubricant oil is heated by the heating medium in the lubricant oil heat exchanger 64 and the temperature of the lubricant oil is increased, the refrigerant in the lubricant oil is vaporized, and the viscosity of the lubricant oil may be secured.

A part of the lubricant oil heated by the lubricant oil heat exchanger 64 and discharged via the second lubricant oil circulation flow path 62 is circulated into the lubricant oil storage portion 13, and the other part thereof is introduced via the injection flow path 70.

When the lubricant oil circulated into the lubricant oil storage portion 13 is supplied to the screw compressor 10, the temperature in the screw compressor 10 is increased so that pressure of the entire system is increased and damage may be be prevented from occurring due to a low pressure when the screw compressor 10 starts up. Also, the lubricant oil heated by the lubricant oil heat exchanger 64 and supplied to the screw compressor 10 may absorb or vaporize a part of the refrigerant in the compressive chamber of the screw compressor 10 when the screw compressor 10 starts up so that damage caused by flooded start may be reduced.

The lubricant oil introduced via the injection flow path 70 may be injected into the motor 12 and the screw rotors 11, respectively, via the motor injection flow path 71 and the screw rotor injection flow path 72. The lubricant oil heated by the lubricant oil heat exchanger 64 is directly injected into the motor 12 and the screw rotors 11 so that introduction of the liquid refrigerant into the compressive chamber may be reduced when the screw compressor 10 starts up later.

The controller (not shown) operates the lubricant oil circulation pump 66 until the temperature inside the screw compressor 10 is equal to or higher than a preset temperature, and opens the injection flow path opening/closing valve 73. Here, the preset temperature will be about 60° C., for example. When the temperature inside the screw compressor 10 reaches the preset temperature, the controller (not shown) stops an operation of the lubricant oil circulation pump 66 and closes the injection flow path opening/closing valve 73.

Subsequently, the screw compressor 10 may start up so that the energy system may operate normally. When the screw compressor 10 starts up and operates normally, the refrigerant compressed by the screw compressor 10 is condensed by the condenser 20, and the refrigerant condensed by the condenser 20 is expanded by the expansion device 30 and then is introduced into the evaporator 40. After the refrigerant is heated by the heating medium introduced via the evaporator heat source flow path 50 and evaporated using the evaporator 40, the refrigerant circulates into the screw compressor 10.

While the screw compressor 10 operates normally, as described above, when the temperature of the lubricant oil in the screw compressor 10 is equal to or higher than the preset temperature, the lubricant oil circulation pump 66 may operate for cooling of the lubricant oil, and the injection flow path opening/closing valve 73 may be opened.

When the lubricant oil circulation pump 66 operates, the lubricant oil in the lubricant oil storage portion 13 is introduced into the lubricant oil heat exchanger 64 via the first lubricant oil circulation flow path 61.

The lubricant oil heat exchanger 64 performs a heat-exchanging operation of the heating medium discharged from the evaporator 40 after the evaporator 40 is heated by the heating medium, and the lubricant oil. Because heat of the heating medium is taken when the evaporator 40 is heated by the heating medium, the temperature of the heating medium is lower than the temperature of the lubricant oil. Thus, cooling of the lubricant oil may be performed by the lubricant oil heat exchanger 64.

Thus, no additional heater, etc. for heating the lubricant oil in the screw compressor 10 is required so that there is no power consumption for driving the heater, etc. and thus efficiency can be improved.

In addition, the heating medium that is not used as the heat source for the evaporator 40 is used to heat the lubricant oil before the screw compressor 10 starts up so that the efficiency of energy usage may be further improved.

In addition, when the screw compressor 10 operates, the heating medium discharged from the evaporator 40 after the evaporator 40 is heated by the heating medium, is used to cool the lubricant oil so that the efficiency of energy usage can be further improved.

In addition, the lubricant oil heated by the lubricant oil heat exchanger 64 is directly injected into the motor 12 and the screw rotor 11 so that introduction of the liquid refrigerant into the compressive chamber can be reduced when the screw compressor 10 starts up later.

Figure 5:
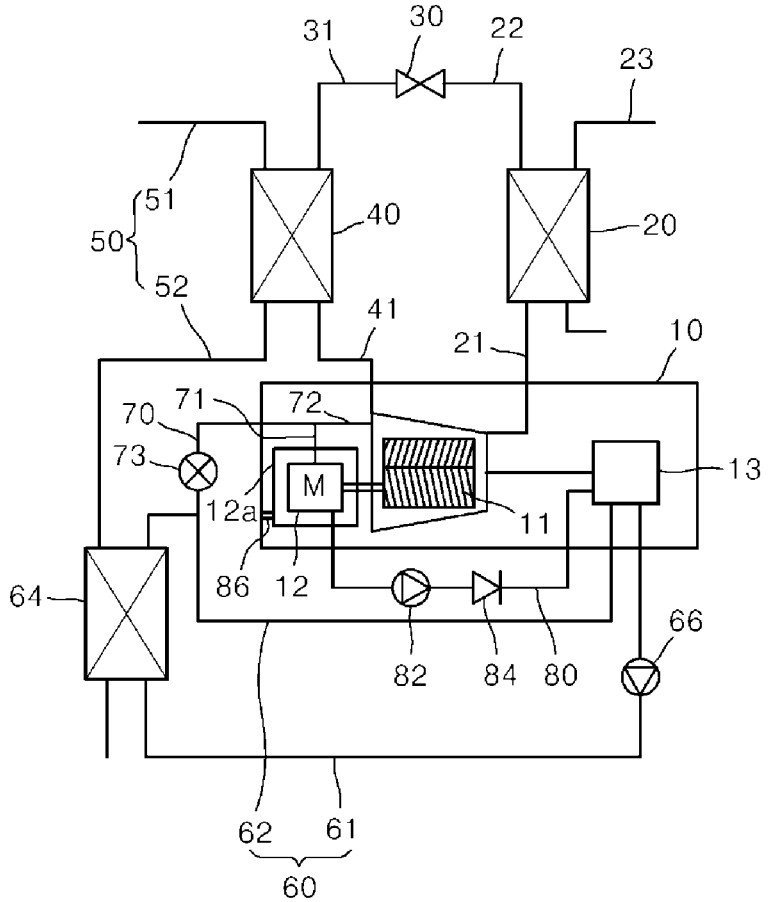
FIG. 5 is a schematic view of a configuration of an energy system according to a third embodiment of the present invention.
Figure 6:
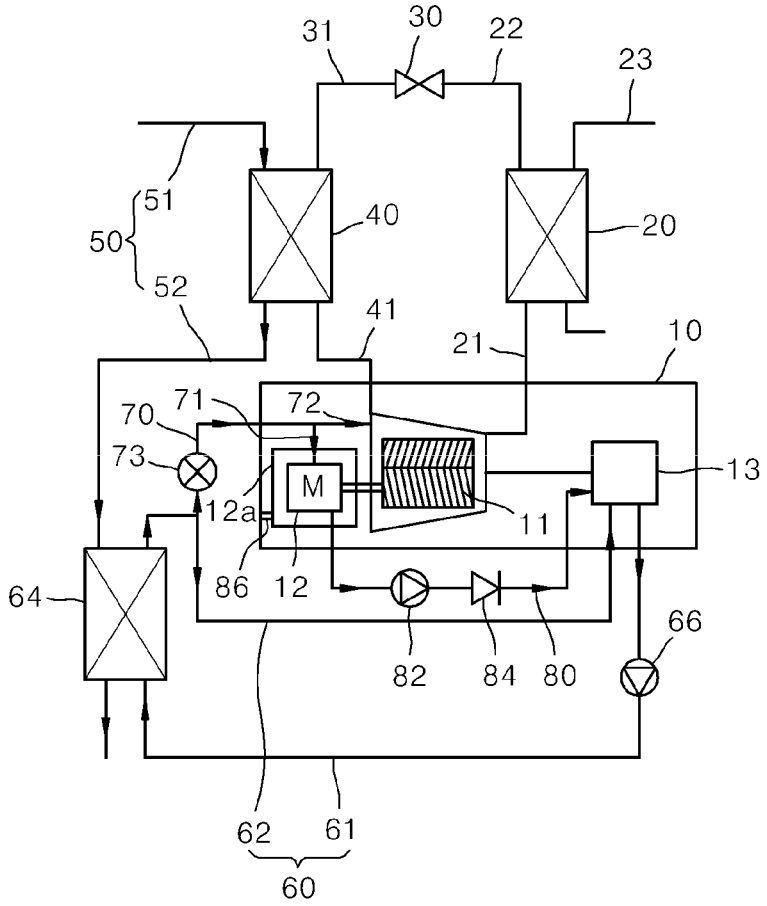
FIG. 6 is a view illustrating an operating state of the energy system illustrated in FIG. 5 in which lubricant oil is heated before a screw compressor starts up.
Figure 7:
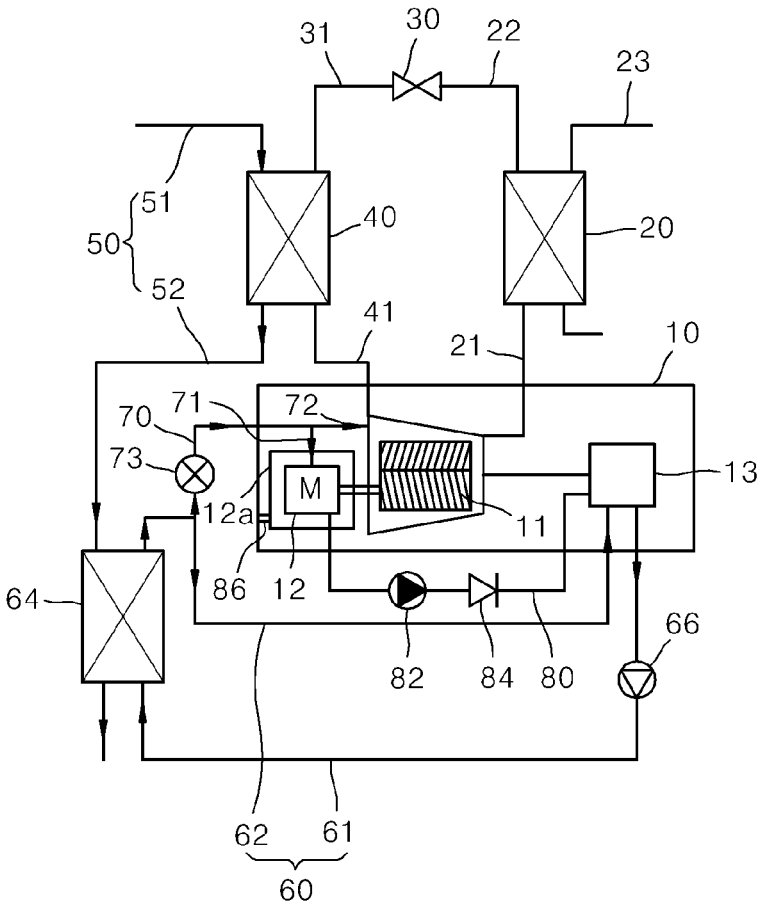
FIG. 7 is a view illustrating a state in which an operation of a lubricant oil discharge pump of the energy system illustrated in FIG. 5 stops.

FIG. 5 is a schematic view of a configuration of an energy system according to a third embodiment of the present invention. FIG. 6 is a view illustrating an operating state of the energy system illustrated in FIG. 5 in which lubricant oil is heated before a screw compressor starts up. FIG. 7 is a view illustrating a state in which an operation of a lubricant oil discharge pump of the energy system illustrated in FIG. 5 stops.

Referring to FIGS. 5 through 7, the energy system according to the third embodiment of the present invention is a heat pump. A difference between the heat pump of the third embodiment and the heat pump of the second embodiment is that the heat pump according to the third embodiment further includes a lubricant oil discharge flow path 80 in which a motor chamber 12*a* and the lubricant oil storage portion 13 are connected to each other so that lubricant oil including a refrigerant in the motor chamber 12*a* is discharged toward the lubricant oil storage portion 13 before the screw compressor 10 starts up, and a lubricant oil discharge pump 82 installed on the lubricant oil discharge flow path 80. Thus, the difference will be described in detail.

The lubricant oil discharge flow path 80 connects the motor chamber 12*a* and the lubricant oil storage portion 13, thereby guiding the lubricant oil including the refrigerant in the motor chamber 12*a* to the lubricant oil storage portion 13. A check valve 84 that prevents backflow of the lubricant oil is installed on the lubricant oil discharge flow path 80.

A water level sensor 86 is installed in the motor chamber 12*a* so as to detect the water level of the lubricant oil in the motor chamber 12*a*. The controller may stop an operation of the lubricant oil discharge pump 82 when the water level detected by the water level sensor 86 is less than a preset water level.

An operation of the energy system (the heat pump) having the above configuration according to the third embodiment of the present invention will be described as follows.

Referring to FIG. 6, before the screw compressor 10 starts up, the controller operates both the lubricant oil circulation pump 66 and the lubricant oil discharge pump 82 and opens the injection flow path opening/closing valve 73.

When the lubricant oil discharge pump 82 operates, the lubricant oil introduced into the motor chamber 12*a* is delivered to the lubricant oil storage portion 13. Thus, the lubricant oil including the liquid refrigerant introduced into the motor chamber 12*a* may be prevented in advance from being introduced into the screw rotor 11 when the screw compressor 10 starts up later.

When the lubricant oil circulation pump 66 operates, the lubricant oil in the lubricant oil storage portion 13 is introduced into the lubricant oil heat exchanger 64 via the first lubricant oil circulation flow path 61.

The lubricant oil heat exchanger 64 performs a heat-exchanging operation of the lubricant oil introduced via the first lubricant oil circulation flow path 61 and the heating medium on the evaporator heat source discharge flow path 52. Before the screw compressor 10 starts up, the heat-exchanging operation of the heating medium of the evaporator heat source flow path 50 and the refrigerant is not performed by the evaporator 40 so that heat of the heating medium on the evaporator heat source flow path 50 may be intactly supplied to the lubricant oil heat exchanger 64. That is, before the screw compressor 10 starts up, the temperature of the heating medium on the evaporator heat source discharge flow path 52 is temperature of about 60° C. that is higher than the room temperature so that the heating medium on the evaporator heat source discharge flow path 52 may be provided as a sufficient heat source for heating the lubricant oil in the lubricant oil heat exchanger 64. Thus, when the lubricant oil is heated by the heating medium in the lubricant oil heat exchanger 64 and the temperature of the lubricant oil is increased, the refrigerant in the lubricant oil is vaporized, and the viscosity of the lubricant oil may be secured.

A part of the lubricant oil heated by the lubricant oil heat exchanger 64 and discharged via the second lubricant oil circulation flow path 62 is circulated into the lubricant oil storage portion 13, and the other part thereof is introduced via the injection flow path 70.

When the lubricant oil circulated into the lubricant oil storage portion 13 is supplied to the screw compressor 10, the temperature in the screw compressor 10 is increased so that pressure of the entire system is increased and damage may be prevented from occurring due to a low pressure when the screw compressor 10 starts up. Also, the lubricant oil heated by the lubricant oil heat exchanger 64 and supplied to the screw compressor 10 may absorb or vaporize a part of the refrigerant in the compressive chamber of the screw compressor 10 when the screw compressor 10 starts up so that damage caused by flooded start may be reduced.

The lubricant oil introduced via the injection flow path 70 may be injected into the motor 12 and the screw rotor 11, respectively, via the motor injection flow path 71 and the screw rotor injection flow path 72. The lubricant oil heated by the lubricant oil heat exchanger 64 is directly injected into the motor 12 and the screw rotor 11 so that introduction of the liquid refrigerant into the compressive chamber may be reduced when the screw compressor 10 starts up later.

The controller (not shown) operates the lubricant oil circulation pump 66 and the lubricant oil discharge pump 82 until the temperature inside the screw compressor 10 is equal to or higher than a preset temperature, and opens the injection flow path opening/closing valve 73. Here, the preset temperature will be about 60°, for example. When the temperature inside the screw compressor 10 reaches the preset temperature, the controller (not shown) stops an operation of the lubricant oil circulation pump 66 and an operation of the lubricant oil discharge pump 82 and closes the injection flow path opening/closing valve 73.

Referring to FIG. 7, before the screw compressor 10 starts up, the controller (not shown) stops the operation of the lubricant oil discharge pump 82 when the water level detected by the water level sensor 86 is less than the preset water level. In this case, the operation of the lubricant oil circulation pump 66 is maintained. Also, the injection flow path opening/closing valve 73 is also opened. That is, the lubricant oil discharge pump 82 operates only when the water level in the motor chamber 12*a* is equal to or higher than the preset water level. Thus, the water level of the lubricant oil in the motor chamber 12*a* may be maintained at the present water level.

Subsequently, the screw compressor 10 may start up so that the energy system may operate normally. When the screw compressor 10 starts up and operates normally, the refrigerant compressed by the screw compressor 10 is condensed by the condenser 20, and the refrigerant condensed by the condenser 20 is expanded by the expansion device 30 and then is introduced into the evaporator 40. After the refrigerant is heated by the heating medium introduced via the evaporator heat source flow path 50 and evaporated using the evaporator 40, the refrigerant circulates into the screw compressor 10.

While the screw compressor 10 operates normally, as described above, when the temperature of the lubricant oil in the screw compressor 10 is equal to or higher than the preset temperature, the lubricant oil circulation pump 66 may operate for cooling of the lubricant oil, and the injection flow path opening/closing valve 73 may be opened.

When the lubricant oil circulation pump 66 operates, the lubricant oil in the lubricant oil storage portion 13 is introduced into the lubricant oil heat exchanger 64 via the first lubricant oil circulation flow path 61.

The lubricant oil heat exchanger 64 performs a heat-exchanging operation of the heating medium discharged from the evaporator 40 after the evaporator 40 is heated by the heating medium, and the lubricant oil. Because heat of the heating medium is taken when the evaporator 40 is heated by the heating medium, the temperature of the heating medium is lower than the temperature of the lubricant oil. Thus, cooling of the lubricant oil may be performed by the lubricant oil heat exchanger 64.

Thus, no additional heater, etc. for heating the lubricant oil in the screw compressor 10 is required so that there is no power consumption for driving the heater, etc. and thus efficiency may be improved.

In addition, the heating medium that is not used as the heat source for the evaporator 40 is used to heat the lubricant oil before the screw compressor 10 starts up so that the efficiency of energy usage may be further improved.

In addition, when the screw compressor 10 operates, the heating medium discharged from the evaporator 40 after the evaporator 40 is heated by the heating medium, is used to cool the lubricant oil so that the efficiency of energy usage may be further improved.

In addition, the lubricant oil heated by the lubricant oil heat exchanger 64 is directly injected into the motor 12 and the screw rotor 11 so that introduction of the liquid refrigerant into the compressive chamber may be reduced when the screw compressor 10 starts up later.

As described above, in an energy system according to the one or more embodiments of the present invention, a heating medium supplied to an evaporator is used to heat lubricant oil in a screw compressor before the screw compressor starts up so that the efficiency of energy usage can be further improved.

In addition, no additional heater for heating the lubricant oil in the screw compressor is required so that there is no power consumption for driving a heater, etc. and efficiency can be improved.

In addition, when the screw compressor operates, the heating medium discharged from the evaporator after the evaporator is heated by the heating medium, is used to cool the lubricant oil so that the efficiency of energy usage can be further improved.

In addition, the lubricant oil heated by a lubricant oil heat exchanger is directly injected into a motor and a screw rotor so that introduction of a liquid refrigerant into a compressive chamber can be reduced when the screw compressor starts up later.

Furthermore, the lubricant oil introduced into the motor is discharged toward a lubricant oil storage portion before the screw compressor starts up so that the liquid refrigerant can be prevented in advance from being introduced into the screw rotor when the screw compressor starts up.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An energy system comprising:

a screw compressor;

a condenser;

an expansion device;

an evaporator;

a lubricant oil heat-exchanging unit comprising:

a lubricant oil heat-exchanger configured to perform a heat-exchanging operation of lubricant oil in a lubricant oil storage portion provided in the screw compressor and a heating medium on an evaporator heat source flow path;

a lubricant oil circulation flow path configured to connect the lubricant oil storage portion and the lubricant oil heat exchanger, to deliver the lubricant oil in the lubricant oil storage portion to the lubricant oil heat exchanger, and to circulate the lubricant oil heat-exchanged by the lubricant oil heat exchanger into the lubricant oil storage portion; and a lubricant oil circulation pump installed on the lubricant oil circulation flow path and configured to pump the lubricant oil in the lubricant oil storage portion;

an injection flow path configured to inject the lubricant oil bypassed via the lubricant oil circulation flow path and heat-exchanged by the lubricant oil heat exchanger into the screw compressor;

an injection flow path opening/closing valve installed on the injection flow path;

a lubricant oil discharge flow path configured to guide the lubricant oil including the refrigerant at a motor provided in the screw compressor to be discharged toward the lubricant oil storage portion;

a lubricant oil discharge pump installed on the lubricant oil discharge flow path; and a controller, before the screw compressor starts up, configured to operate the lubricant oil circulation pump and the lubricant oil discharge pump and to open the injection flow path opening/closing valve, and when temperature inside the screw compressor reaches a preset temperature, configured to stop an operation of the lubricant oil circulation pump and an operation of the lubricant oil discharge pump and to close the injection flow path opening/closing valve.

2. The energy system of claim 1, wherein, after operating the lubricant oil circulation pump before the screw compressor starts up, the controller controls an operation of the lubricant oil circulation pump depending on temperature inside the screw compressor.

3. The energy system of claim 1, further comprising an injection flow path configured to inject the lubricant oil bypassed via the lubricant oil circulation flow path and heat-exchanged by the lubricant oil heat exchanger into the screw compressor.

4. The energy system of claim 3, wherein the injection flow path comprises:

a motor injection flow path configured to inject the lubricant oil heat-exchanged by the lubricant oil heat exchanger into a motor provided in the screw compressor; and a screw rotor injection flow path configured to inject the lubricant oil heat-exchanged by the lubricant oil heat exchanger into a screw rotor provided in the screw compressor.

5. The energy system of claim 3, further comprising an injection flow path opening/closing valve installed on the injection flow path and configured to control injection of the lubricant oil.

6. The energy system of claim 1, wherein the screw compressor comprises a motor chamber in which a motor is provided, a compressive chamber in which a screw rotor is provided, and a lubricant oil storage portion in which the lubricant oil is stored, wherein the lubricant oil discharge flow path is configured to connect the motor chamber and the lubricant oil storage portion and to discharge the lubricant oil including the refrigerant in the motor chamber toward the lubricant oil storage portion before the screw compressor starts up.

7. The energy system of claim 6, further comprising a water level sensor installed in the motor chamber and configured to detect a water level of the lubricant oil, wherein the controller stops an operation of the lubricant oil discharge pump when the water level detected by the water level sensor is less than a preset water level.

8. The energy system of claim 6, wherein a check valve is installed on the lubricant oil discharge flow path to prevent backflow of the lubricant oil.

9. The energy system of claim 1, wherein the energy system is a heat pump.

10. The energy system of claim 1, wherein the lubricant oil heat-exchanging unit is configured to perform a heat-exchanging operation of the heating medium on an evaporator heat source flow path and lubricant oil including a refrigerant inside the screw compressor, to heat the lubricant oil by the heating medium before the screw compressor starts up, and to cool the lubricant oil by the heating medium discharged from the evaporator after the evaporator is heated by the heating medium, after the screw compressor starts up.

* * * * *